US009460597B1

(12) United States Patent
Clark et al.

(10) Patent No.: US 9,460,597 B1
(45) Date of Patent: Oct. 4, 2016

(54) SYSTEMS AND METHODS FOR SECURITY TAG DETACHMENT OR DEACTIVATION AUTHORIZATION

(71) Applicants: John J. Clark, Boynton Beach, FL (US); Pierre-Michel G. Simon, Gradignan (FR)

(72) Inventors: John J. Clark, Boynton Beach, FL (US); Pierre-Michel G. Simon, Gradignan (FR)

(73) Assignee: Tyco Fire & Security GmbH, Neuhausen Rheinfall (CH)

( * ) Notice: Subject to any disclaimer, the term of this patent is extended or adjusted under 35 U.S.C. 154(b) by 0 days.

(21) Appl. No.: 14/744,635

(22) Filed: Jun. 19, 2015

(51) Int. Cl.
*G08B 13/24* (2006.01)

(52) U.S. Cl.
CPC ..... *G08B 13/246* (2013.01); *G08B 13/2454* (2013.01)

(58) Field of Classification Search
CPC ..... G08B 13/246; G08B 13/2454
See application file for complete search history.

(56) References Cited

U.S. PATENT DOCUMENTS 5,426,419 A 6/1995 Nguyen et al.
5,528,914 A 6/1996 Nguyen et al.
5,535,606 A 7/1996 Nguyen et al.
5,942,978 A 8/1999 Shafer
5,955,951 A 9/1999 Wischerop et al.
6,296,185 B1 * 10/2001 Dejaeger ..... A47F 9/046 235/383
7,689,468 B2 * 3/2010 Walker ..... G06Q 10/087 705/26.4
2012/0321146 A1 * 12/2012 Kundu ..... G06Q 20/202 382/118
2013/0278425 A1 * 10/2013 Cunningham ..... G08B 13/246 340/572.1
2014/0224867 A1 * 8/2014 Werner ..... G06Q 30/0623 235/375
2015/0009035 A1 * 1/2015 Rasband ..... G08B 13/2454 340/572.3
2015/0254941 A1 * 9/2015 Shimazaki ..... G07G 1/009 705/17

* cited by examiner

*Primary Examiner* — Van Trieu
(74) *Attorney, Agent, or Firm* — Fox Rothschild LLP; Robert J. Sacco; Carol E. Thorstad-Forsyth

(57) ABSTRACT

Systems (100) and methods (200) for security tag detachment or deactivation authorization. The methods involve: communicating at least one first product code for each article of a plurality of purchased articles from a Point-Of-Sale ("POS") to a remote authorization system; generating by the remote authorization system an authorization code to facilitate authorization of detachment or deactivation of security tags attached only to said plurality of purchased articles, in response to the first product code; using the authorization code to obtain a list of articles identifying first articles of the plurality of purchased articles which have security tags attached thereto; and authorizing the detachment or deactivation of only the security tags that are attached to the articles identified in the list of articles.

20 Claims, 4 Drawing Sheets

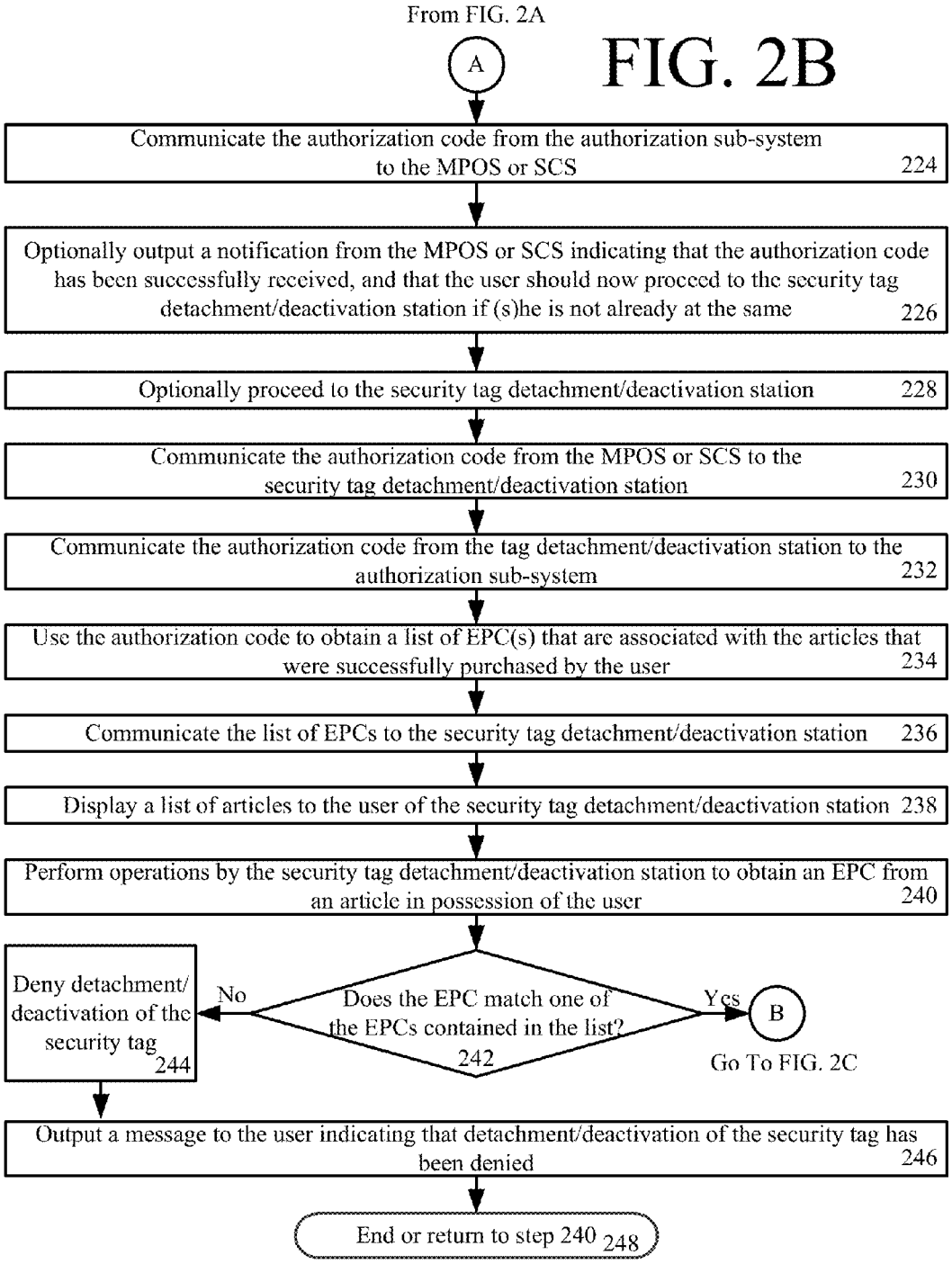
From FIG. 2A
A
FIG. 2B
Communicate the authorization code from the authorization sub-system to the MPOS or SCS 224
Optionally output a notification from the MPOS or SCS indicating that the authorization code has been successfully received, and that the user should now proceed to the security tag detachment/deactivation station if (s)he is not already at the same 226
Optionally proceed to the security tag detachment/deactivation station 228
Communicate the authorization code from the MPOS or SCS to the security tag detachment/deactivation station 230
Communicate the authorization code from the tag detachment/deactivation station to the authorization sub-system 232
Use the authorization code to obtain a list of EPC(s) that are associated with the articles that were successfully purchased by the user 234
Communicate the list of EPCs to the security tag detachment/deactivation station 236
Display a list of articles to the user of the security tag detachment/deactivation station 238
Perform operations by the security tag detachment/deactivation station to obtain an EPC from an article in possession of the user 240
Does the EPC match one of the EPCs contained in the list? 242
No
Deny detachment/ deactivation of the security tag 244
Yes
B
Go To FIG. 2C
Output a message to the user indicating that detachment/deactivation of the security tag has been denied 246
End or return to step 240 248

SYSTEMS AND METHODS FOR SECURITY TAG DETACHMENT OR DEACTIVATION AUTHORIZATION

BACKGROUND OF THE INVENTION

Electronic Article Surveillance ("EAS") systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element (e.g., an acousto-magnetic element) can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching the security tag therefrom. The security tag must be detached from the article upon purchase thereof in order to prevent the visual or audible alarm from being generated.

One type of EAS security tag can include a tag body which engages a tack. The tack usually includes a tack head and a sharpened pin extending from the tack head. In use, the pin is inserted through the article to be protected. The shank or lower part of the pin is then locked within a cooperating aperture formed through the housing of the tag body. In some scenarios, the tag body may contain a Radio Frequency Identification ("RFID") element or label. The RFID element can be interrogated by an RFID reader to obtain RFID data therefrom.

The EAS security tag may be removed or detached from the article using a detaching unit. Examples of such detaching units are disclosed in U.S. Pat. No. 5,426,419 ("the '419 patent), U.S. Pat. No. 5,528,914 ("the '914 patent"), U.S. Pat. No. 5,535,606 ("the '606 patent"), U.S. Pat. No. 5,942,978 ("the '978 patent") and U.S. Pat. No. 5,955,951 ("the '951 patent"). The detaching units disclosed in the listed patents are designed to operate upon a two-part hard EAS security tag. Such an EAS security tag comprises a pin and a molded plastic enclosure housing EAS marker elements. During operation, the pin is inserted through an article to be protected (e.g., a piece of clothing) and into an aperture formed through at least one sidewall of the molded plastic enclosure. The pin is securely coupled to the molded plastic enclosure via a clamp disposed therein. The pin is released by a detaching unit via a probe. The probe is normally retracted within the detaching unit. Upon actuation, the probe is caused to travel out of the detaching unit and into the enclosure of the EAS security tag so as to release the pin from the clamp or disengage the clamp from the pin. Once the pin is released from the clamp, the EAS security tag can be removed from the article.

While EAS security tags help reduce retail theft, improper use of the detaching unit is an ever growing problem that is inhibiting the effectiveness of the security tags. For example, an unscrupulous store employee may conspire to allow customers to steal merchandise by a practice known as "sweethearting". "Sweethearting" involves collusion between the store employee and a customer. Typically, a cashier scans an inexpensive item for the customer to ring a sale and apparently complete the transaction. But then the cashier uses a detaching unit to remove the EAS security tag from a much more expensive item which was not scanned. The customer is then free to leave the premises with the expensive item without having paid therefore. In effect, "sweethearting" can cost businesses a relatively large amount of dollars each year.

SUMMARY OF THE INVENTION

This disclosure concerns implementing systems and methods for security tag detachment or deactivation authorization. The methods involve communicating at least one first product code for each article of a plurality of purchased articles from a POS (e.g., a POS station, a mobile POS or a self-checkout station) to a remote authorization system. The product code can include, but is not limited to, a Universal Product Code ("UPC") and an Electronic Product Code ("EPC"). In response to the first product code, the remote authorization system generates an authorization code. The authorization code is provided to facilitate authorization of detachment or deactivation of security tags attached only to the plurality of purchased articles. In this regard, the authorization code is used to obtain a list of articles identifying first articles of the plurality of purchased articles which have security tags attached thereto. For example, the list of articles may comprise EPCs for the first articles. Next, authorization is provided for detaching or deactivating only the security tags that are attached to the articles identified in the list of articles. In some scenarios, the security tags are detached or deactivated by a customer of a retail store.

In some scenarios, the authorization code is communicated: from the remote authorization system to the POS; from the POS to a security tag detachment/deactivation station (e.g., via a near field communication); and from the security tag detachment/deactivation station to the remote authorization system. In response to the authorization code, the remote authorization system performs operations to provide the list of articles to the security tag detachment/deactivation station, in response to the authorization code.

In those or other scenarios, the authorization comprises obtaining a second product code from an article in a user's possession and comparing the second product code to a plurality of product codes contained in the list of articles. The detachment or deactivation of a security tag is authorized when the second product code matches one of the plurality of product codes contained in the list of articles. In contrast, the detachment or deactivation of a security tag is denied when the second product code does not match one of the plurality of product codes contained in the list of articles.

DESCRIPTION OF THE DRAWINGS

Embodiments will be described with reference to the following drawing figures, in which like numerals represent like items throughout the figures, and in which:

FIGS. 2A through 2C collectively provide a flow diagram of an exemplary method for security tag detachment or deactivation authorization.

DETAILED DESCRIPTION OF THE INVENTION

Figure 1:
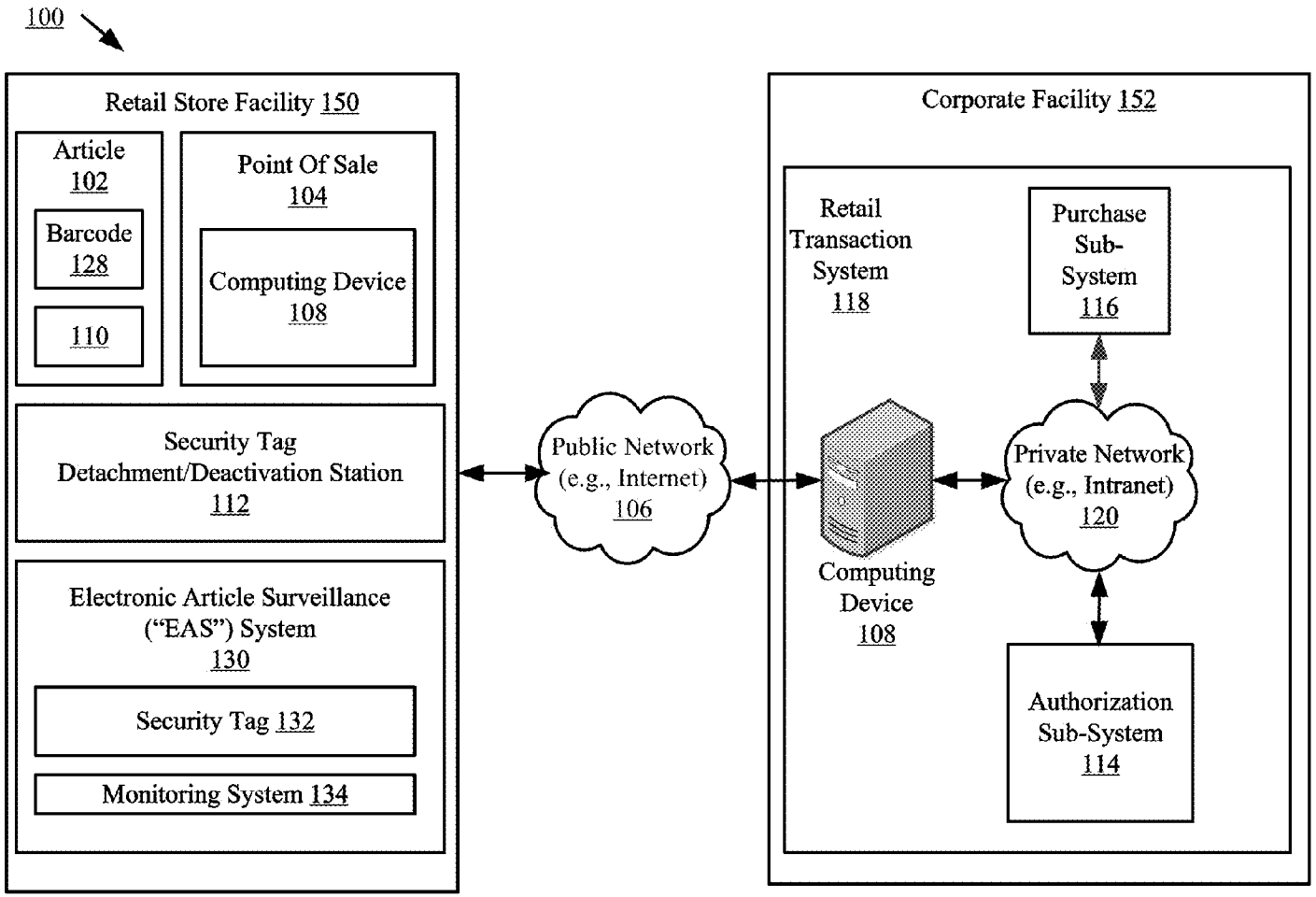
FIG. 1 is an illustration of an exemplary architecture for an EAS system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Mobile shopping apps, shopping websites and self-checkout solutions are becoming more prevalent in retail stores. Presently, there is no way for a retail store to provide a customer with authorization to detach and/or deactivate security tags attached to protected retail items. Accordingly when a customer uses a Mobile Point Of Sale ("MPOS") device or a self-checkout kiosk, the security tags attached to the purchased products trigger an alarm at a retail store's exit. For tag deactivation, some retailers have a deactivation device tied to a fixed POS. Deactivation of a security tag is only enabled when there is a scanned UPC. However, there is no verification that the correct security tag is deactivated.

The systems and methods discussed herein allow authorization of security tag detachment/deactivation by a customer after completing a successful purchase transaction. Accordingly, the present solution facilitates the use of mobile shopping applications, shopping websites and self-checkout solutions in retail establishments that would not be possible due to the use of security tags. The present solution provides advantages to retailers by (1) reducing labor costs for checkout and security tag detachment/deactivation and (2) allowing better management of influx of customers due to mobile checkout options available. The present solution also provides advantages to customers by (1) allowing customers to self-pay using a mobile shopping applications, shopping websites and self-checkout solutions in store with products protected by security tags. As such, there is no need for the customers to stand and wait in checkout lines.

The present solution uses a mobile shopping app, shopping website or self-checkout station to enable the scanning of the UPC or EPC associated with the product. The solution may use multiple tagging technologies in conjunction with each other or a single technology. The security tag to protect the product and a secondary tag as a unique product identifier. The secondary tag could be an RFID tag that uniquely identifies the product by including the EPC. The RFID tag may be incorporated into the security tag as a dual technology tag for a single security tag option or as a separate tag on the product. The dual technology security tag may have a barcode identifying the encoded EPC. Alternatively or additionally, the EPC may be encoded in a way where the UPC is included in the EPC.

Exemplary Systems

Referring now to FIG. 1, there is provided schematic illustrations useful for understanding an exemplary system 100 in accordance with the present invention. System 100 comprises a retail store facility 150 including an EAS 130. The EAS 130 comprises a monitoring system 134 and at least one security tag 132. Although not shown in FIG. 1, the security tag 132 is attached to an article 102, thereby protecting the article 102 from an unauthorized removal from the retail store facility 150. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of the article 102 from the retail store facility 150.

During store hours, a customer (not shown) may desire to purchase the article 102. The customer can purchase the article 102 using a Point Of Sale ("POS") 104. The POS 104 can include, but is not limited to, a self-checkout POS station, a mobile POS station or a mobile POS device. In either scenario, a retail transaction application executing on a computing device 108 of the POS 104 facilitates the exchange of data between the article 102, security tag 132, customer, and/or Retail Transaction System ("RTS") 118 of a corporate facility 152. For example, after the retail transaction application is launched, the customer is prompted to start a retail transaction process for purchasing the article 102. The retail transaction process can be started simply by performing a user software interaction, such as depressing a key on a keypad of the computing device 108 or touching a button on a touch screen display of the computing device 108.

In the MPOS scenarios, the computing device 108 comprises a handheld communication device running the retail transaction application. The handheld communication device includes, but is not limited to, a cellular phone, a smart phone, a portable computer, a tablet, or a personal digital assistant.

Subsequently, the customer may manually input into the retail transaction application article information. Alternatively or additionally, the customer may place the computing device 108 of the POS 104 in proximity of the article 102, or vise versa. As a result of this placement, the POS 104 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the computing device 108 of the POS 104 via a wireless communication, such as a barcode communication, RFID communication or a Near Field Communication ("NFC").

In the barcode scenario, the article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of the article 102. The barcode 128 is read by a barcode scanner/reader (not shown in FIG. 1) of the POS 104. Barcode scanners/readers are well known in the art. Any known or to be known barcode scanner/reader can be used herein without limitation.

In the NFC scenarios, article 102 may comprise an NFC enabled device 110. The NFC enabled device 110 can be separate from the security tag 132 or comprise the security tag 132. An NFC communication occurs between the NFC enabled device 110 and the computing device 108 over a relatively small distance (e.g., N centimeters or N inches, where N is an integer such as twelve). The NFC communication may be established by touching components 102, 108 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the POS 104 obtains the article information, payment information is input into the retail transaction application of POS 104. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the POS 104 automatically performs operations for establishing a retail transaction session with the RTS 118. The retail transaction session can involve: communicating the article information and payment information from the POS 104 to the RTS 118 via a public network 106 (e.g., the Internet); completing a purchase transaction by the RTS 118; and communicating a response message from the RTS 118 to the POS 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 118 using the article information and payment information. In this regard, such information may be received by a computing device 108 of the RTS 118 and forwarded thereby to a sub-system of a private network 120 (e.g., an Intranet). For example, the article information and purchase information can also be forwarded to and processed by a purchase sub-system 116 to complete a purchase transaction. When the purchase transaction is completed, a message is generated and sent to the POS 104 indicating whether the article 102 has been successfully or unsuccessfully purchased.

If the article 102 has been successfully purchased, then a security tag detaching/deactivation process can be started automatically by the RTS 118 or by the POS 104. Alternatively, the user (not shown in FIG. 1) can start the security tag detaching/deactivation process by performing a user-software interaction using the POS 104. In all three scenarios, the article information can optionally be forwarded to and processed by an authorization sub-system 114 to generate an authorization code that is useful for ensuring that security tags are only detached from or deactivated when attached to successfully purchased articles. The authorization code can be generated using the UPCs and/or EPCs of articles which have been successfully purchased. The authorization code is then sent from the authorization sub-system 114 to the POS 104 such that the POS 104 can perform or cause a security tag detachment/deactivation station 112 to perform tag detachment/deactivation operations.

The tag detachment operations are generally configured to cause the security tag 132 to actuate a detaching mechanism (not shown in FIG. 1). In this regard, the security tag detachment/deactivation station 112 generates a detach command and sends a wireless detach signal including the detach command to the security tag 132. The security tag 132 authenticates the detach command and activates the detaching mechanism. For example, the detach command causes a pin to be retracted such that the security tag can be removed from the article 102. Once the security tag 132 has been removed from article 102, the customer 140 can carry the article 102 through the surveillance zone without setting off the alarm.

The tag deactivation operations are generally configured to cause an EAS device of the security tag 132 to be deactivated. In this regard, the security tag detachment/deactivation station 112 generates a deactivate command and sends a wireless deactivate signal including the deactivate command to the security tag 132. The security tag 132 authenticates the deactivate command and deactivates the EAS device. Once the EAS device has been deactivated, the customer 140 can carry the article 102 through the surveillance zone without setting off the alarm.

Figure 2A:
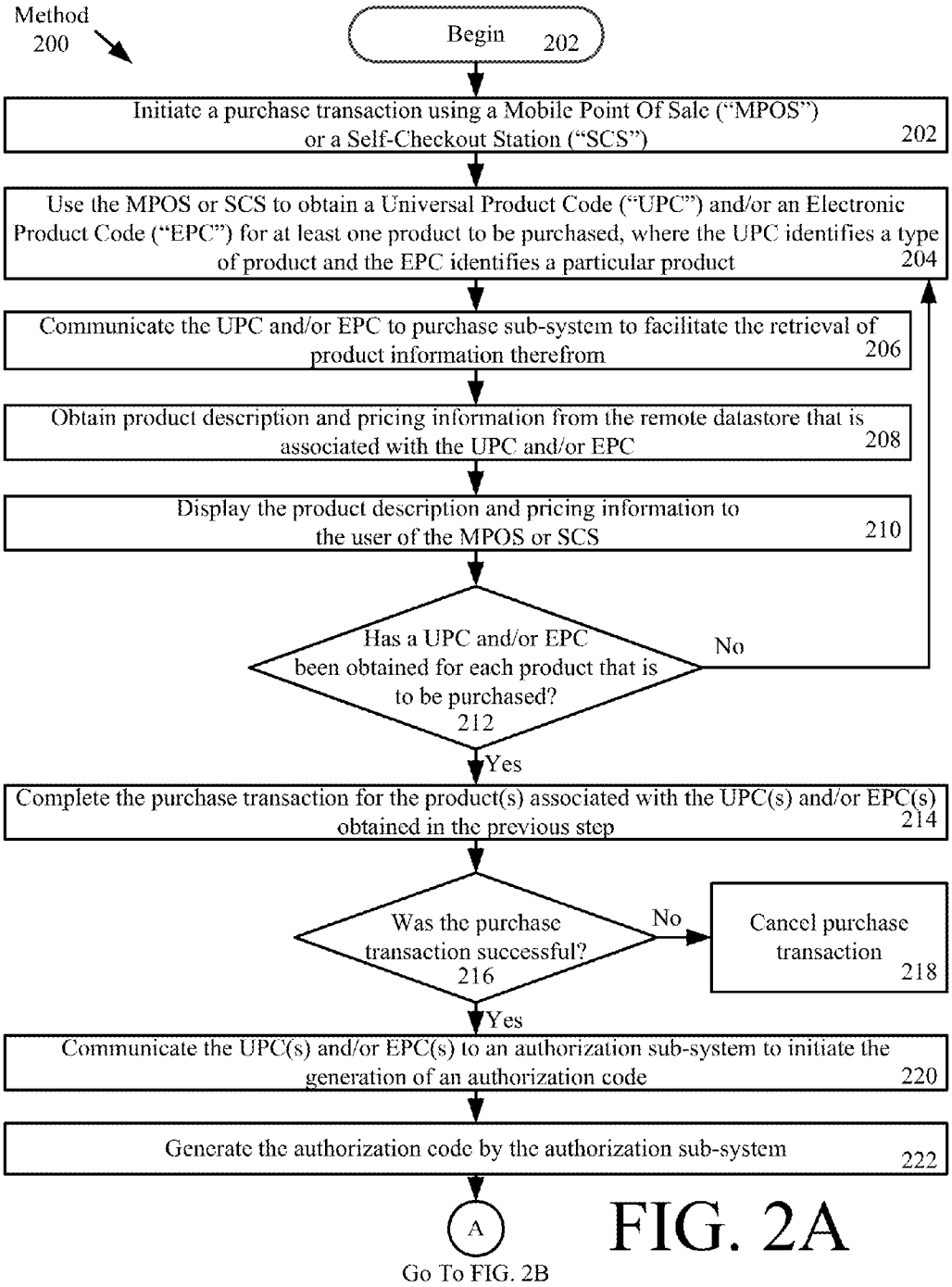
Figure 2C:
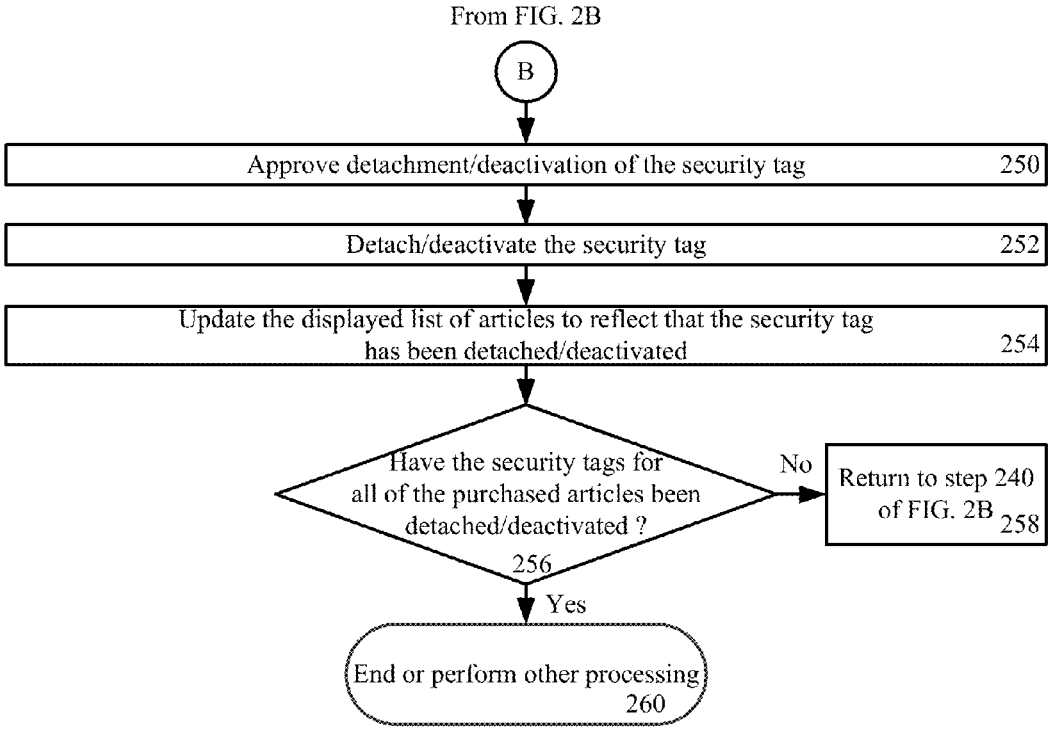

Referring now to FIGS. 2A-2C, there is provided a flow diagram of an exemplary method 200 for security tag detachment or deactivation authorization. Method 200 provides a methodology to allow a consumer to remove a security tag from an article that has been successfully purchased and/or deactivate an EAS element of a security tag attached to an article that has been successfully purchased. Currently, there is no process for allowing the customer to only detach security tags from and/or deactivate security tags attached to products that (s)he has successfully purchased.

As shown in FIG. 2A, method 200 begins with step 202 and continues with step 204 where a purchase transaction is initiated using a MPOS or Self-Checkout Station ("SCS") (e.g., POS 104 of FIG. 1). Techniques for initiating such a purchase transaction are well known in the art, and therefore will not be described herein. After completing step 204, step 206 is performed where the MPOS or SCS is used to obtain a UPC and/or an EPC for at least one product to be purchased. The UPC uniquely identifies a type of product. The EPC uniquely identifies a particular product. The UPC and/or EPC can be obtained using one or more scanning technologies. The scanning technologies include, but are not limited to, RFID technology, NFC technology and/or barcode technology.

The UPC and/or EPC is then communicated to a purchase sub-system (e.g., purchase sub-system 116 of FIG. 1) to facilitate the retrieval of product information therefrom, as shown by step 206. In this regard, the purchase sub-system may comprise or have access to a remote datastore in which product information was pre-stored. The product information includes, but is not limited to, product descriptions and purchase prices. The purchase sub-system then uses the UPC and/or EPC to obtain any associated product description and pricing information from the remote datastore, as shown by step 208. The product description and pricing information is communicated in step 210 to the MPOS or SCS so that it can be displayed to the user thereof.

At this time, a decision step 212 is performed to determine whether a UPC and/or EPC has(have) been obtained for each product that is to be purchased. If a UPC and/or EPC has(have) not been obtained for each product that is to be purchased [212:NO], then method 200 returns to step 204. In contrast, if the UPC and/or EPC has(have) been obtained for each product that is to be purchased [212:YES], method 200 continues with step 214. Step 214 involves completing the purchase transaction for the product(s) associated with the UPC(s) and/or EPC(s) previously obtained. If the purchase transaction was not successful [216:NO], then step 218 is performed where the purchase transaction is canceled. If the purchase transaction was successful [216:YES], then step 220 is performed for starting a security tag detachment/deactivation process.

Step 220 involves communicating the UPC(s) and/or EPC(s) from the MPOS or SCS to an authorization sub-system (e.g., authorization sub-system 114 of FIG. 1). In some scenarios, only the UPCs are obtained from the articles to be purchased. In this case, the authorization sub-system will perform actions to identify the particular products that have been purchased using the UPC(s). For example, a look-up table can be used for this purpose. This step is performed so that the authorization sub-system has knowledge of the particular articles which (a) have been successfully purchased and (b) have security tags that need to be deactivated or detached therefrom.

Once the UPC(s) and/or EPC(s) have been received by the authorization sub-system, step 222 is performed where the authorization sub-system generates an authorization code. Notably, the authorization code is generated so as to provide a means for subsequently authorizing the detachment or deactivation of security tags attached only to the previously purchased articles. The authorization code includes, but is not limited to, a numeric sequence, an alphanumeric sequence, or an alphabetic sequence that unique identifies a single security tag detachment/deactivation process. The authorization code can be generated using a chaotic, random or pseudo-random algorithm. In this regard, the authorization code is a single use code. Upon completing step 222, method 200 continues with step 224 of FIG. 2B.

As shown in FIG. 2B, step 224 involves communicating the authorization code from the authorization sub-system to the MPOS or SCS. Next in optional step 226, a notification is output from the MPOS or SCS. The notification indicates that the authorization code has been successfully received and/or that the user should now proceed to the security tag detachment/deactivation station (e.g., security tag detachment/deactivation station 112 of FIG. 1) if (s)he is not already at the same. In response to the notification, the user optionally proceeds to the security tag detachment/deactivation station, as shown by step 228.

In a next step 230, the authorization code is communicated from the MPOS or SCS to the security tag detachment/deactivation station. In turn, the authorization code is communicated from the security tag detachment/deactivation station to the authorization sub-system, as shown by step 232. At the authorization sub-system, the authorization code is used in step 234 to obtain a list of EPCs that are associated with the articles (a) that were successfully purchased by the user and (b) which need to have their security tags detached/deactivated. The list of EPCs is provided to the security tag detachment/deactivation station, as shown by step 236. The list of EPCs is used by the security tag detachment/deactivation station to generate a list of articles which need to have their security tags detached or deactivated. The list of articles is presented to the user in step 238 via a display screen of the security tag detachment/deactivation station. Additional information may also be presented along with the list of articles. This additional information can include, but is not limited to, article name, article type, and/or article characteristics (e.g., size, color, pictures, etc.).

Next, the security tag detachment/deactivation station performs operations to obtain an EPC from an article in the user's possession 240. The EPC is then compared to the list of EPCs. This comparison can be performed by the security tag detachment/deactivation station or the authorization sub-system 242.

If the EPC does not match one of the EPCs contained in the list [242:NO], then steps 244-246 are performed. These steps involve: denying the detachment/deactivation of the security tag; and outputting a message to the user indicating that the security tag's detachment/deactivation has been denied. Subsequently, step 248 is performed where method 200 ends or returns to step 240.

If the EPC does match one of the EPCs contained in the list [242:YES], then method 200 continues with steps 250-254 of FIG. 2C. These steps involve: approving the detachment/deactivation of the security tag; detaching/deactivating the security tag; and updating the displayed list of articles to reflect that the security tag has been detached/deactivated.

Upon completing step 254, a decision step 256 is performed to determine whether the security tags for all of the purchased products have been detached/deactivated. If all of the security tags have not been detached/deactivated [256:NO], then step 258 is performed where method 200 returns to step 240. In contrast, if all of the security tags have been detached/deactivated [256:YES], then step 260 is performed where method 200 ends or other processing is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for security tag detachment or deactivation authorization, comprising:

communicating at least one first product code for each article of a plurality of purchased articles from a Point-Of-Sale ("POS") to a remote authorization system;

in response to the first product code, generating by the remote authorization system an authorization code to facilitate authorization of detachment or deactivation of security tags attached only to said plurality of purchased articles, the authorization code comprising a single use code uniquely identifying a single security tag detachment or deactivation process for the plurality of purchased articles;

using the authorization code to obtain a list of articles identifying first articles of the plurality of purchased articles which have security tags attached thereto; and authorizing the detachment or deactivation of only the security tags that are attached to the articles identified in the list of articles.

2. The method according to claim 1, wherein the product code comprises at least one of a Universal Product Code ("UPC") and an Electronic Product Code ("EPC").

3. The method according to claim 1, wherein the POS is a POS station, a mobile POS station, a mobile POS device or a self-checkout station.

4. The method according to claim 1, wherein the security tags are detached or deactivated by a customer of a retail store.

5. The method according to claim 1, wherein the list of articles comprises Electronic Product Codes ("EPCs") for the first articles.

6. The method according to claim 1, further comprising:

communicating the authorization code from the remote authorization system to the POS;

communicating the authorization code from the POS to a security tag detachment/deactivation station;

communicating the authorization code from the security tag detachment/deactivation station to the remote authorization system; and performing operations by the remote authorization system to provide the list of articles to the security tag detachment/deactivation station, in response to the authorization code.

7. The method according to claim 6, wherein the authorization code is communicated from the POS to the security tag detachment/deactivation station via a near field communication.

8. The method according to claim 1, wherein said authorization comprises obtaining a second product code from an article in a user's possession and comparing the second product code to a plurality of product codes contained in the list of articles.

9. The method according to claim 8, wherein the detachment or deactivation of a security tag is authorized when the second product code matches one of the plurality of product codes contained in the list of articles.

10. The method according to claim 8, wherein the detachment or deactivation of a security tag is denied when the second product code does not match one of the plurality of product codes contained in the list of articles.

11. A system, comprising:

a Point-Of-Sale ("POS") configured to communicate at least one first product code for each article of a plurality of purchased articles to a remote authorization system;

said remote authorization system configured to generate an authorization code in response to a first product code and to facilitate authorization of detachment or deactivation of security tags attached only to said plurality of purchased articles, the authorization code comprising a single use code uniquely identifying a single security tag detachment or deactivation process for the plurality of purchased articles; and a security tag detachment/deactivation station configured to use the authorization code to obtain a list of articles identifying first articles of the plurality of purchased articles which have security tags attached thereto, and authorize the detachment or deactivation of only the security tags that are attached to the articles identified in the list of articles.

12. The system according to claim 11, wherein the product code comprises at least one of a Universal Product Code ("UPC") and an Electronic Product Code ("EPC").

13. The system according to claim 11, wherein the POS is a POS station, a mobile POS station, a mobile POS device or a self-checkout station.

14. The system according to claim 11, wherein the security tags are detached or deactivated by a customer of a retail store.

15. The system according to claim 11, wherein the list of articles comprises Electronic Product Codes ("EPCs") for the first articles.

16. The system according to claim 11, wherein the remote authorization system communicates the authorization code to the POS, the POS communicates the authorization code to the security tag detachment/deactivation station, the security tag detachment/deactivation station communicates the authorization code to the remote authorization system, and operations are performed by the remote authorization system to provide the list of articles to the security tag detachment/deactivation station, in response to the authorization code.

17. The system according to claim 16, wherein the authorization code is communicated from the POS to the security tag detachment/deactivation station via a near field communication.

18. The system according to claim 11, wherein authorization to detach or deactivate a security tag is provided based on results of comparing a second product code obtained from an article in a user's possession to a plurality of product codes contained in the list of articles.

19. The system according to claim 18, wherein the detachment or deactivation of a security tag is authorized when the second product code matches one of the plurality of product codes contained in the list of articles.

20. The system according to claim 18, wherein the detachment or deactivation of a security tag is denied when the second product code does not match one of the plurality of product codes contained in the list of articles.

* * * * *